US005874816A

United States Patent [19]

Ishii

[11] Patent Number: 5,874,816

[45] Date of Patent: Feb. 23, 1999

[54] METHOD OF PREVENTING WIRE FROM BECOMING ENTANGLED IN REINFORCING BAR FASTENING MACHINE

[75] Inventor: Syuichi Ishii, Tokyo, Japan

[73] Assignee: Max Co. Ltd., Tokyo, Japan

[21] Appl. No.: 906,245

[22] Filed: Aug. 4, 1997

[30] Foreign Application Priority Data

Aug. 2, 1996 [JP] Japan ..... 8-220521

[51] Int. Cl.[6] ..... B21F 9/02

[52] U.S. Cl. ..... 318/430; 318/453; 318/474; 318/484; 140/93.6; 140/57

[58] Field of Search ..... 140/93 R, 93.2, 140/93.6, 93 A, 57, 117–119, 149; 318/563, 445–447, 474–477, 484, 430, 432–434, 452, 453

[56] References Cited

U.S. PATENT DOCUMENTS

| | | | |
|---|---|---|---|
| 4,252,157 | 2/1981 | Ohnishi | 140/93 A |
| 4,267,914 | 5/1981 | Saar | 192/147 |
| 4,362,192 | 12/1982 | Furlong et al. | 140/93.6 |
| 4,780,654 | 10/1988 | Shoji et al. . | |
| 4,834,148 | 5/1989 | Mugurma et al. | 140/119 |
| 4,858,312 | 8/1989 | Van Naarden | 29/861 |
| 4,901,775 | 2/1990 | Scott et al. | 140/123.5 |
| 4,953,598 | 9/1990 | McCavey | 140/57 |
| 5,279,336 | 1/1994 | Kusakari et al. | 140/57 |
| 5,339,869 | 8/1994 | Hayakawa | 140/119 |
| 5,509,994 | 4/1996 | Recchia et al. | 156/468 |
| 5,595,220 | 1/1997 | Leban et al. | 140/123.6 |
| 5,613,530 | 3/1997 | Kincel et al. | 140/119 |
| 5,682,927 | 11/1997 | Takahashi et al. | 140/119 |
| 5,708,339 | 1/1998 | Frazier et al. | 318/468 |

*Primary Examiner*—Brian Sircus
*Attorney, Agent, or Firm*—Morgan, Lewis & Bockius LPP

[57] ABSTRACT

A method of preventing a wire from becoming entangled in a reinforcing bar fastening machine having a wire feed device for feeding a wire for fastening reinforcing bars, a guide arm for guiding the wire so as to wind around a crossing point of the reinforcing bars in the form of a loop, a twisting device for performing a tying operation by twisting while picking up part of the loop of the wire wound around the crossing point of the reinforcing bars, and a cutting device for cutting the loop from the wire on a reinforcing bar fastening machine side, the method comprises the steps of: monitoring a torque of a motor for driving the twisting device; and stopping the operation of the twisting device when no increasing tendency is observed in changes in the torque after a predetermined time has elapsed from an operation start timing of the twisting device.

3 Claims, 6 Drawing Sheets

METHOD OF PREVENTING WIRE FROM BECOMING ENTANGLED IN REINFORCING BAR FASTENING MACHINE

BACKGROUND OF THE INVENTION

The invention relates to a method of preventing a wire from becoming entangled in a reinforcing bar fastening machine that judges that a reinforcing bar fastening wire is fastening an object to be fastened such as reinforcing bars and other structures correctly, and that forcibly brings the fastening operation to an end when it is judged that the reinforcing bar fastening wire is not fastening the object correctly.

Generally, in the case where reinforced concrete is employed for constructing buildings and structures, concrete is deposited after crisscrossing reinforcing bars have been fastened. Recently, a reinforcing bar fastening machine is used for fastening reinforcing bars. As shown in FIG. 5, such reinforcing bar fastening machine is operated in the following manner. A main switch 20 is turned on in advance, and a wire 22 is fed by operating a trigger lever 21 at the time of performing a fastening operation. Then, the thus fed wire 22 is further forwarded so as to form a loop from a curved section in the front of a guide arm 23, and such loop of the wire is wound around a crossing point of reinforcing bars 24. Then, part of the wire loop 25 is thereafter picked up with a twisting hook 26 and twisted to thereby fasten the reinforcing bars. The torque of a motor 28 that drives a twisting device 27 for turning the twisting hook 26 is measured, and when the torque of the motor reaches a predetermined value, the reinforcing bar fastening machine judges that the fastening operation has been completed, and therefore stops the operation of the twisting device (the motor 28).

However, when a wire fed from the reinforcing bar fastening machine is not guided regularly into the wire guide while abutted against reinforcing bars or other structures, or when the twisting hook fails to pick up the wire loop even if the wire has been wound around the reinforcing bars or other structures correctly, the twisting device performs the twisting operation with no load. Since there is no load, the torque of the motor does not increase (see FIG. 6). For this reason, the peak of the torque cannot be detected. Therefore, a control means applies a forced stop signal for stopping the motor to thereby forcibly stop the operation of the twisting device upon elapse of a predetermined time set in advance. However, when the twisting device performs the twisting operation for the set time by forwarding the twisting hook with the wire not wound around the reinforcing bars, the wire gets entangled in the twisting hook, which in turn has made the operation of removing the entangled wire extremely cumbersome.

SUMMARY OF THE INVENTION

The invention has been made to overcome the aforementioned problem. The object of the invention is, therefore, to provide a method of preventing a wire from becoming entangled in a reinforcing bar fastening machine, the method forcibly bringing a fastening operation to an end when a reinforcing bar fastening machine judges that a reinforcing bar fastening wire is not fastening an object to be fastened such as reinforcing bars and other structures correctly to thereby prevent the wire from becoming entangled in a twisting hook, so that not only a cumbersome operation after the trouble can be avoided, but also fastening operation efficiency can be improved.

To overcome the aforementioned problems, the invention is applied to a method of preventing a wire from becoming entangled in a reinforcing bar fastening machine. The reinforcing bar fastening machine has a wire feed device for feeding a wire for fastening reinforcing bars, a guide arm for guiding the wire so as to wind around a crossing point of the reinforcing bars in the form of a loop, a twisting device for performing a tying operation by twisting while picking up part of the loop of the wire wound around the crossing point of the reinforcing bars, and a cutting device for cutting the loop from the wire on a reinforcing bar fastening machine side. In such reinforcing bar fastening machine, the method involves the steps of: monitoring a torque of a motor for driving the twisting device; and stopping the operation of the twisting device when no increasing tendency is observed in changes in the torque after a predetermined time has elapsed from an operation start timing of the twisting device.

DETAILED DESCRIPTION OF THE PREFERRED EMBODIMENTS

A mode of embodiment of the invention will now be described with reference to the drawings.

Figure 1:
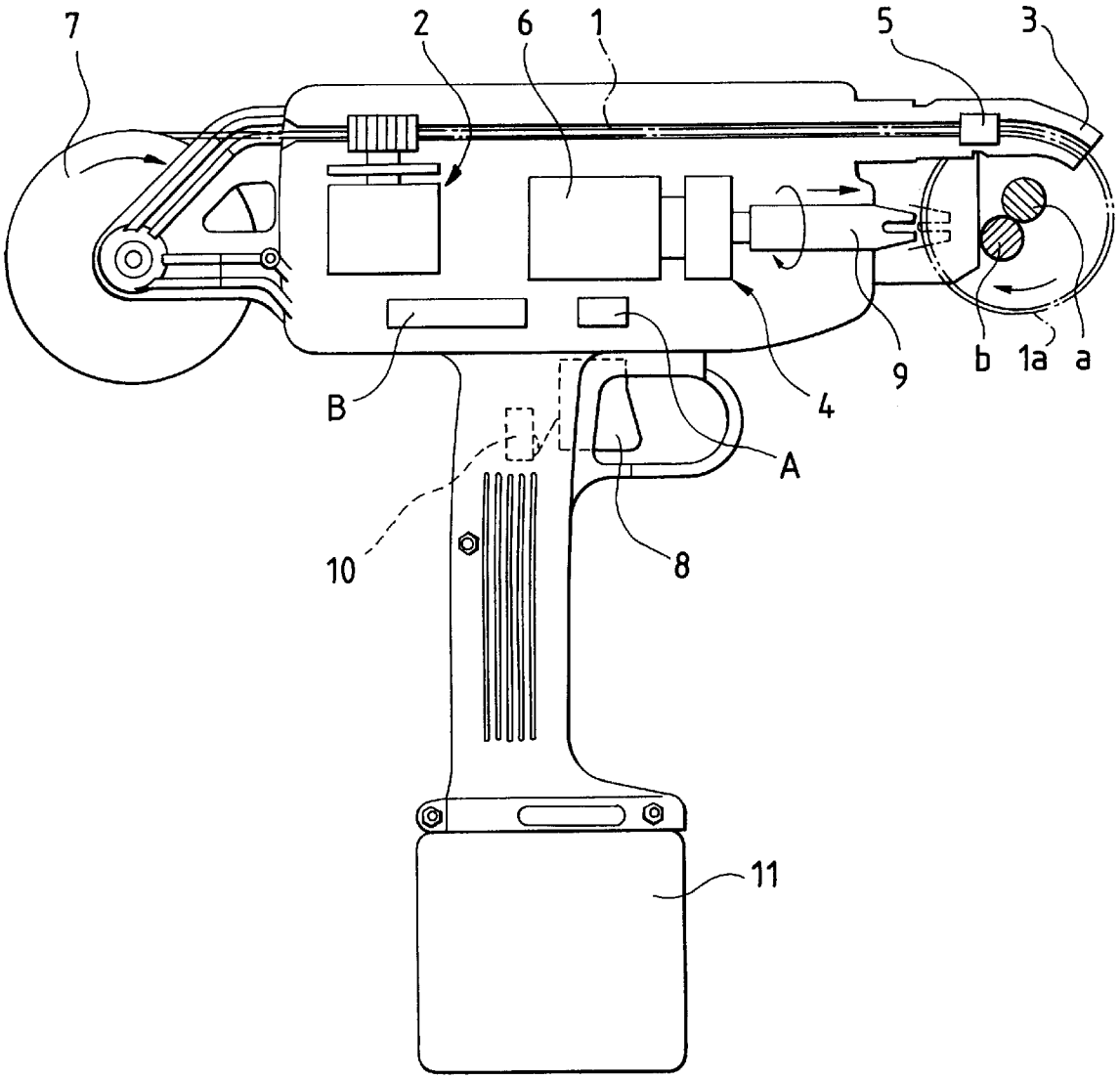
FIG. 1 is a side view of a reinforcing bar fastening machine to which a method of preventing a wire from becoming entangled of the invention is applied.

FIG. 1 shows the main portion of a reinforcing bar fastening machine. This reinforcing bar fastening machine includes: a wire feed device 2 that feeds a wire 1 wound around a spool 7 forward; a guide arm 3 that forms a portion of the fed wire 1 into a loop; a twisting device 4 that picks up a portion of the looped wire 1 and tying such portion by twisting; and a cutting device 5 that cuts the wire loop so as to be separated from the wire 1 on the spool side. The wire feed device 2, the twisting device 4, and the cutting device 5 are operated by a motor mounted on the fastening machine main body.

This reinforcing bar fastening machine is operated in the following manner. A main switch is turned on in advance, and at the time of fastening reinforcing bars a, b, a trigger lever 8 is operated to thereby turn a trigger switch 10 on. As a result, the wire 1 is fed from the spool 7 by the wire feed device 2. A portion of the thus fed wire 1 is formed into a loop by the guide arm 3. Then, the twisting device 4 is activated so that part of a wire loop 1*a* is picked up by a hook 9 and twisted to thereby fasten the reinforcing bars. In addition, the cutting device 5 cuts the wire loop 1*a* so that the wire loop 1*a* is separated from the wire 1 on the spool side.

By the way, this reinforcing bar fastening machine has a measuring means A that measures a torque of the motor 6 of the twisting device 4 and a control means B that judges a fastening end timing from the torque measured by the measuring means and brings the fastening operation to an end by stopping the motor 6.

Figure 2:
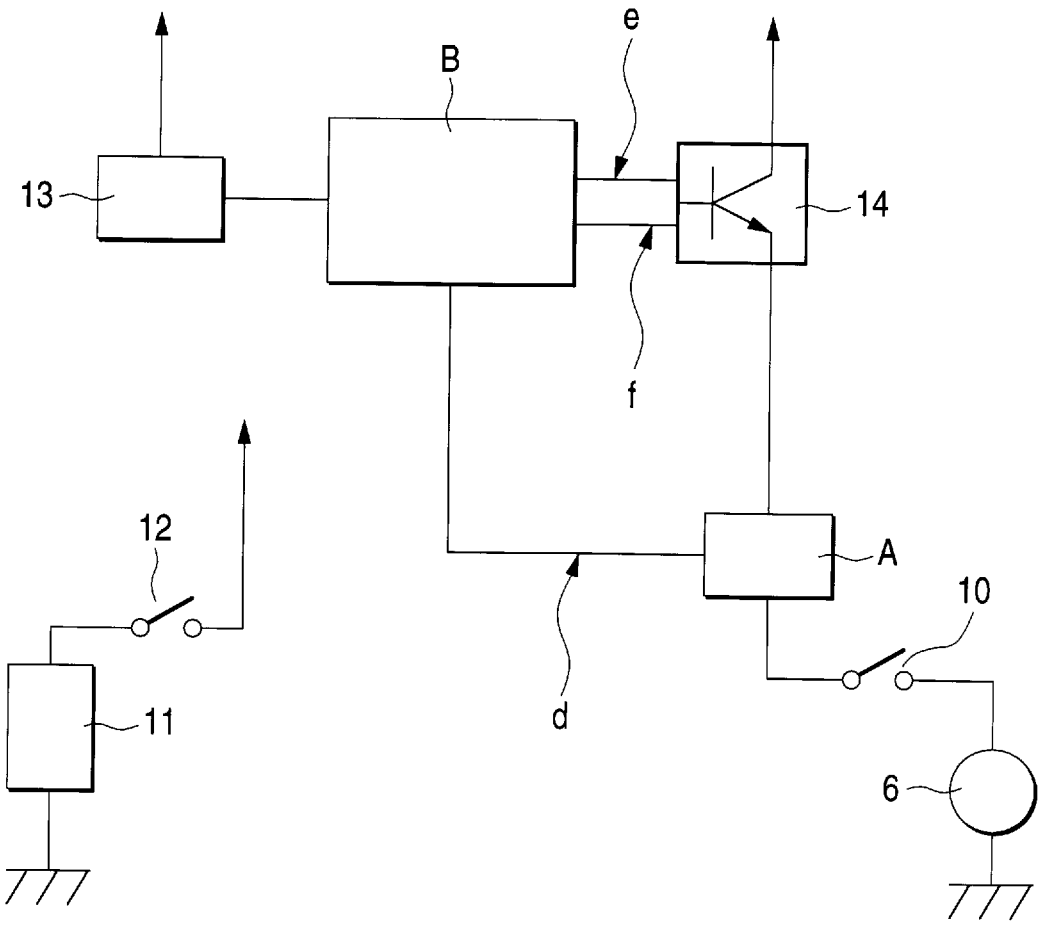
FIG. 2 is a block diagram of the reinforcing bar fastening machine.

FIG. 2 is a block diagram of the reinforcing bar fastening machine. In FIG. 2, reference character A denotes the measuring means; B, the control means; 10, the trigger switch; 11, a battery pack; 12, the main switch; and 13, a DC—DC converter that converts a voltage supplied from the battery pack to a voltage for operating the control means.

The measuring means A is connected in series to the motor 6 and measures the drive current of the motor 6. The measuring means A can measure changes in the torque of the motor 6 by measuring the drive current. The measuring means A is constructed of a resistor, and obtains the drive current flowing through the circuit from a terminal voltage across the resistor. It may be noted that the measuring means A can be constructed of a Hall element type current sensor or the like that obtains the drive current by measuring a magnetic flux generated by the current flowing through the circuit. A measured result d obtained by the measuring means A is applied to the control means B.

Figure 3:
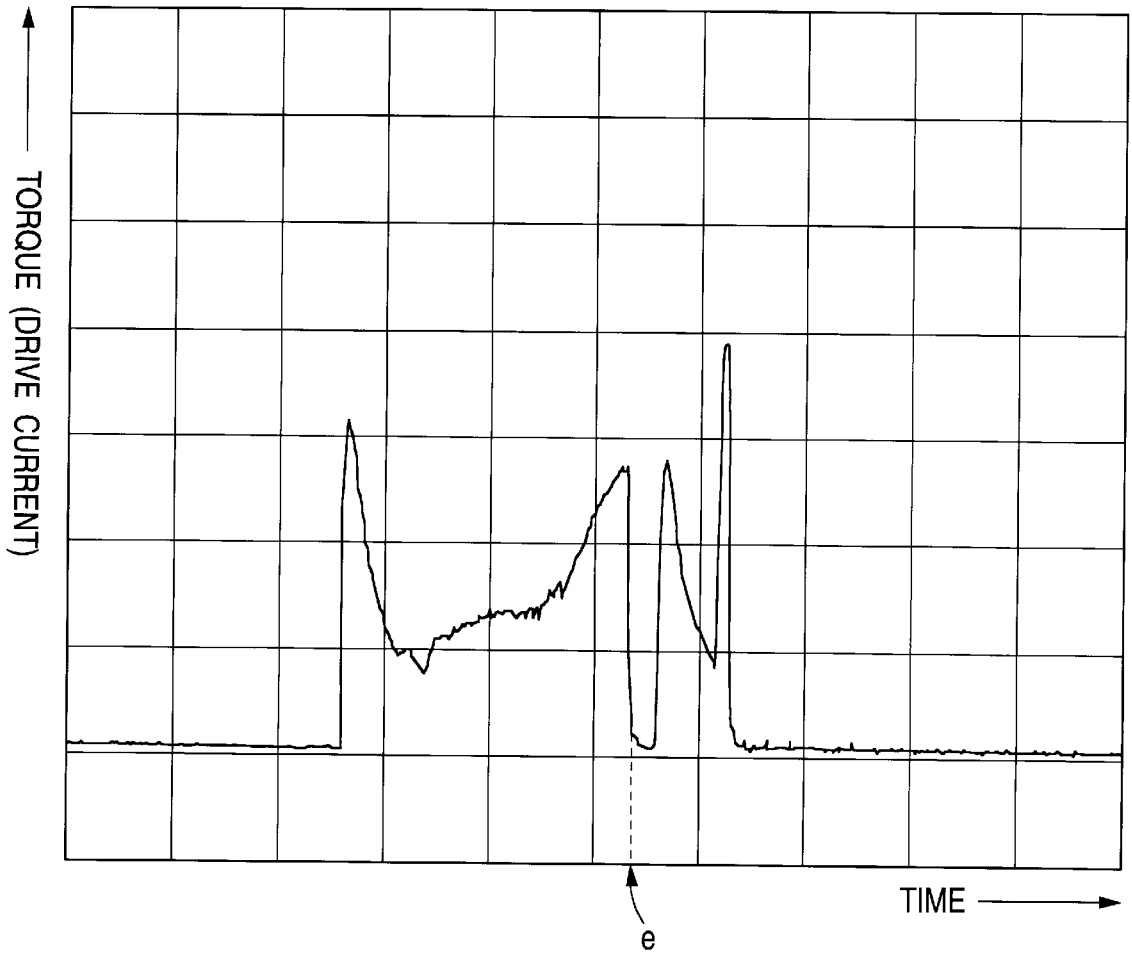
FIG. 3 is a drive current characteristic diagram in the case where a fastening operation is performed under normal conditions.

The control means B is constructed of a microprocessor, and monitors changes in the torque of the motor 6 based on a control program resident in a built-in memory. By measuring the drive current, this control means B monitors an increase in the torque of the motor 6 for twisting a wire from the fact that a degree of tying by twisting is increased as the tying operation by twisting proceeds. When the torque (drive current) has reached a peak, the control means B judges that the reinforcing bar fastening force has maximized, applies a fastening end signal e, and turns off a switch (power transistor) 14 connected in series to the electric circuit of the motor 6 to thereby disconnect the electric circuit and stop the motor 6 (see FIG. 3).

Figure 4:
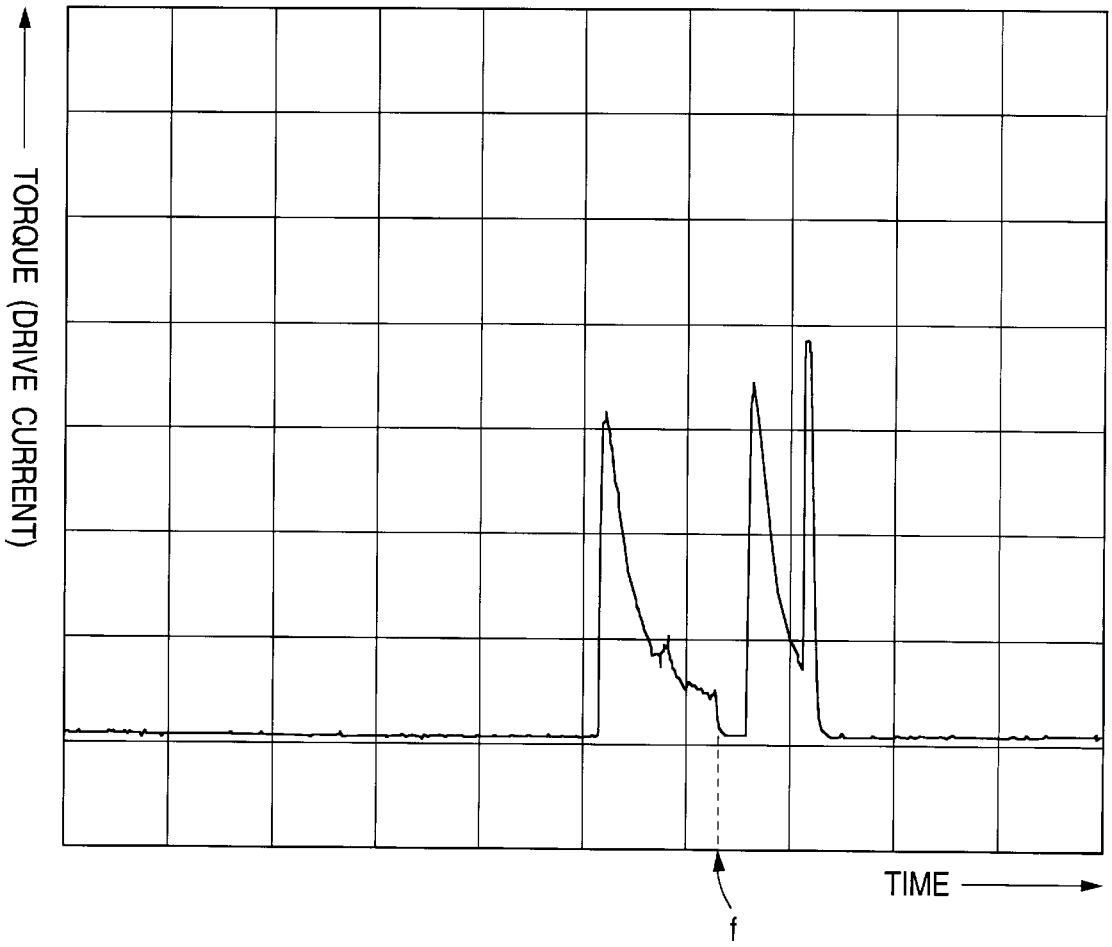
FIG. 4 is a drive current characteristic diagram in the case where a fastening operation is performed under abnormal conditions.
Figure 5:
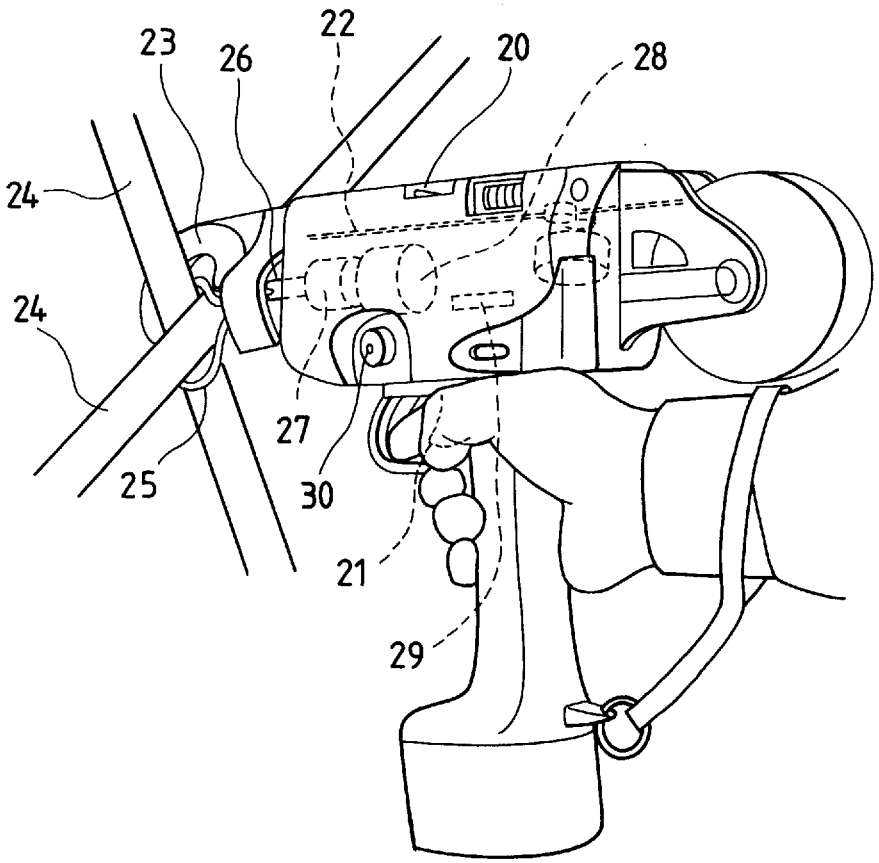
FIG. 5 is a perspective view showing how a conventional reinforcing bar fastening machine is used.
Figure 6:
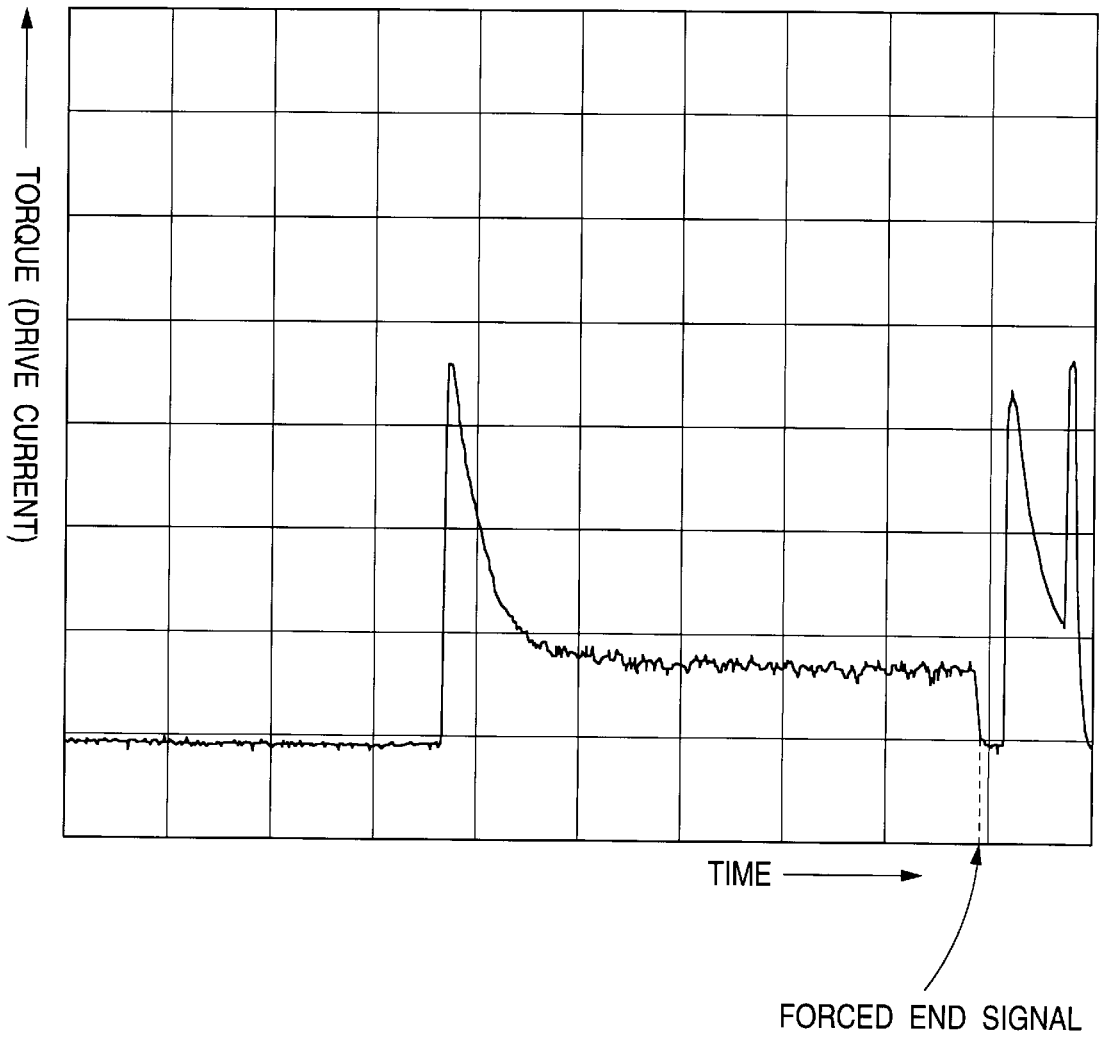
FIG. 6 is a drive current characteristic diagram of a motor in the conventional reinforcing bar fastening machine.

By the way, the control means B samples the torque (drive current) outputted from the measuring means A every unit time, and measures the rate of change of the torque (drive current) per unit time. When no increasing tendency is observed in changes in the torque after a predetermined time has elapsed (when the rate of change of the torque does not increase), the control means B judges that the twisting device 4 is operated under no load (either the wire has not been wound around the reinforcing bars, or the hook has not picked up the wire loop), so that the control means B outputs a forced stop signal f to thereby forcibly turn off the switch (power transistor) 14 that is connected in series to the electric circuit of the motor 6, disconnect the electric circuit, stop the motor 6, and forcibly bring the fastening operation to an end even if the fastening operation has not been completed (see FIG. 4).

It may be noted that a next fastening operation can be started by turning on the switch 14 that has once been turned off on condition that the trigger switch 10 is turned off by releasing the trigger lever 8 upon completion of the current fastening operation.

According to the method of preventing a wire from becoming entangled in the reinforcing bar fastening machine, when part of the wire loop 1*a* formed around a crossing point of reinforcing bars is picked up with the hook 9 and tied by twisting the hook 9 while rotating the motor 6, if the wire is not wound around a portion of reinforcing bars to be fastened or if the hook 9 fails to pick up the wire loop, the torque of the motor 6 does not increase because the motor is operating under no load. Therefore, by monitoring changes in the torque, it is judged that the twisting device 4 is not twisting the wire correctly onto the reinforcing bars, so that the operation of the twisting device 4 can be stopped before the wire gets entangled in the hook. As a result, not only the trouble of a wire becoming entangled in the hook can be prevented, but also a single cycle of fastening operation can be reduced because the motor is no longer rotated for a long period of time during abnormality. Hence, a reinforcing bar fastening machine not only with improved operation efficiency but also with excellent operability can be implemented.

While the aforementioned control means monitors an increasing tendency in changes in the torque after a predetermined time has elapsed from an operation start timing of the twisting device, the control means may be operated in the following manner as well. The torque of the motor at the time of performing a fastening operation is set as a reference torque, and a torque measured after a predetermined time has elapsed is compared with the reference torque to judge whether or not the measured torque exceeds the reference torque. If the measured torque does not exceed the reference torque, the control means may judge that the fastening operation is not performed correctly, so that the operation of the twisting device may be stopped.

If the torque of the motor does not change while the wire twisting condition is being monitored, the fastening cycle is stopped, which in turn allows the trouble of the wire becoming entangled in the hook to be prevented. In addition, the fastening cycle is suspended within a short period of time upon occurrence of an abnormality, which in turn contributes to reducing waste time. As a result, a method of preventing a wire from becoming entangled in a reinforcing bar fastening machine having excellent operation efficiency and operability can be provided.

What is claimed is:

1. A method of preventing a wire from becoming entangled in a reinforcing bar fastening machine having a wire feed device for feeding a wire for fastening reinforcing bars, a guide arm for guiding the wire so as to wind around a crossing point of the reinforcing bars in the form of a loop, a twisting device for performing a tying operation by twisting while picking up part of the loop of the wire wound around the crossing point of the reinforcing bars, and a cutting device for cutting the loop from the wire on a reinforcing bar fastening machine side, the method comprising the steps of:

monitoring a torque of a motor for driving the twisting device; and stopping the operation of the twisting device when no increasing tendency is observed in changes in the torque after a predetermined time has elapsed from an operation start timing of the twisting device.

2. The method for preventing a wire from becoming entangled in a reinforcing bar fastening machine according to claim 1, wherein the predetermined time is shorter than a time of the tying operation.

3. A method of preventing a wire from becoming entangled in a reinforcing bar fastening machine having a wire feed device for feeding a wire for fastening reinforcing bars, a guide arm for guiding the wire so as to wind around a crossing point of the reinforcing bars in the form of a loop, a twisting device for performing a tying operation by twisting while picking up part of the loop of the wire wound around the crossing point of the reinforcing bars, and a cutting device for cutting the loop from the wire on a reinforcing bar fastening machine side, the method comprising the steps of:

monitoring a torque of a motor for driving the twisting device; and stopping the operation of the twisting device when the torque is lower than a reference value after a predetermined time has elapsed from an operation start timing of the twisting device, wherein the predetermined time is shorter than a time of the tying operation.

* * * * *